US011739766B2

(12) United States Patent
Sishtla et al.

(10) Patent No.: US 11,739,766 B2
(45) Date of Patent: Aug. 29, 2023

(54) CENTRIFUGAL COMPRESSOR INCLUDING DIFFUSER PRESSURE EQUALIZATION FEATURE

(71) Applicant: Carrier Corporation, Palm Beach Gardens, FL (US)

(72) Inventors: Vishnu M. Sishtla, Palm Beach Gardens, FL (US); William T. Cousins, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 32 days.

(21) Appl. No.: 17/252,769

(22) PCT Filed: May 8, 2020

(86) PCT No.: PCT/US2020/032069
§ 371 (c)(1),
(2) Date: Dec. 16, 2020

(87) PCT Pub. No.: WO2020/231798
PCT Pub. Date: Nov. 19, 2020

(65) Prior Publication Data

US 2021/0270289 A1 Sep. 2, 2021

Related U.S. Application Data

(60) Provisional application No. 62/847,360, filed on May 14, 2019.

(51) Int. Cl.
*F04D 17/10* (2006.01)
*F04D 29/44* (2006.01)
*F04D 29/08* (2006.01)

(52) U.S. Cl.
CPC ..... *F04D 29/441* (2013.01); *F04D 17/10* (2013.01); *F04D 29/083* (2013.01)

(58) Field of Classification Search
CPC ..... F04D 17/10; F04D 29/083; F04D 29/441; F04D 29/665; F04D 29/682; F04D 29/685
See application file for complete search history.

(56) References Cited

U.S. PATENT DOCUMENTS 2,453,524 A 11/1948 McMahan et al.
4,054,398 A * 10/1977 Penny ..... F04D 29/462 415/12

(Continued)

FOREIGN PATENT DOCUMENTS

CN 1637301 A 3/2008
CN 103953560 B 4/2016

(Continued)

OTHER PUBLICATIONS

International search Report and Written Opinion for International Application No. PCT/US2020/032069 dated Jul. 31, 2020.

(Continued)

*Primary Examiner* — David E Sosnowski
*Assistant Examiner* — Theodore C Ribadeneyra
(74) *Attorney, Agent, or Firm* — Carlson, Gaskey & Olds, P.C.

(57) ABSTRACT

A centrifugal compressor includes an impeller configured to drive fluid along a fluid flowpath via a plurality of discrete passages. Each of the discrete passages includes a discrete passage exit. A diffuser portion is disposed circumferentially about the impeller. The diffuser portion includes a plenum connected to each exit of the discrete passages via a plurality of diffuser inlets and an equalization plenum defined adjacent to the impeller. The equalization plenum is fluidly connected to each discrete passage exit via a corresponding slot.

12 Claims, 2 Drawing Sheets

(56) References Cited

U.S. PATENT DOCUMENTS

| | | | | |
|---|---|---|---|---|
| 4,131,389 | A | 12/1978 | Perrone et al. | |
| 4,368,005 | A | 1/1983 | Exley et al. | |
| 4,579,509 | A * | 4/1986 | Jacobi | F04D 29/441 415/199.1 |
| 4,990,053 | A | 2/1991 | Rohne | |
| 5,145,317 | A | 9/1992 | Brasz | |
| 5,277,541 | A | 1/1994 | Palmer | |
| 5,466,118 | A | 11/1995 | Heinrich | |
| 6,224,321 | B1 | 5/2001 | Ebden et al. | |
| 6,338,609 | B1 | 1/2002 | Decker et al. | |
| 6,447,241 | B2 | 9/2002 | Nakao | |
| 6,450,780 | B1 * | 9/2002 | Larjola | F04D 29/057 417/365 |
| 6,699,008 | B2 | 3/2004 | Japikse | |
| 7,025,557 | B2 | 4/2006 | Japikse et al. | |
| 7,095,102 | B2 | 8/2006 | Kajimoto et al. | |
| 7,645,121 | B2 | 1/2010 | Tudor | |
| 8,235,648 | B2 | 8/2012 | LeBlanc | |
| 8,490,408 | B2 | 7/2013 | Nichols et al. | |
| 8,690,522 | B2 | 4/2014 | Nikpour | |
| 8,845,269 | B2 | 9/2014 | Agneray et al. | |
| 9,470,233 | B2 | 10/2016 | Tamaki | |
| 9,816,524 | B2 | 11/2017 | Tamaki | |
| 9,897,110 | B2 * | 2/2018 | Tamaki | F04D 29/4206 |
| 11,143,201 | B2 * | 10/2021 | Duong | F04D 29/685 |
| 2017/0122339 | A1 * | 5/2017 | Sun | F02B 37/04 |

FOREIGN PATENT DOCUMENTS

| | | | |
|---|---|---|---|
| CN | 106640346 | A | 5/2017 |
| CN | 109236745 | A | 1/2019 |
| DE | 102014119562 | A1 | 6/2016 |
| EP | 1157214 | | 6/2004 |

OTHER PUBLICATIONS

International Preliminary Report on Patentability for International Patent Application No. PCT/US2020/032069 completed on Nov. 16, 2021.

* cited by examiner

CENTRIFUGAL COMPRESSOR INCLUDING DIFFUSER PRESSURE EQUALIZATION FEATURE

TECHNICAL FIELD

The present disclosure relates generally to compressor centrifugal compressors, and more specifically to a centrifugal compressor including a discharge pressure equalization feature.

CROSS-REFERENCE TO RELATED APPLICATION

This application claims priority to U.S. Provisional Application No. 62/847,360 filed on May 15, 2019.

BACKGROUND

Rotary machines, such as centrifugal compressors, are commonly utilized in refrigeration and turbine applications. Centrifugal compressors include an impeller that drives and compresses a fluid and provides the compressed fluid to a discharge plenum. The discharge plenum distributes the compressed fluid to a system configured to utilize the compressed fluid. Non-Uniform provision of pressure to the diffuser impacts the upstream space between the impeller and the diffuser inlets and can have a negative impact on compressor operations.

Centrifugal compressors have a range of viable operations, with the range being controlled by a choke dictated by the diffuser configuration and a surge dictated by the impeller and diffuser configuration and flow interaction. In some compressor configurations an outlet of the impeller is connected to the diffuser via multiple distinct passages. Such a configuration can have a reduced range resulting at least in part from local non-uniformity of flow through each of the distinct passages as described above.

SUMMARY OF THE INVENTION

In one exemplary embodiment a centrifugal compressor includes an impeller configured to drive fluid along a fluid flowpath via a plurality of discrete passages, each of the discrete passages including a discrete passage exit, a diffuser portion disposed circumferentially about the impeller, the diffuser portion including a plenum connected to each exit of the discrete passages via a plurality of diffuser inlets, and an equalization plenum defined adjacent to the impeller, the equalization plenum being fluidly connected to each discrete passage exit via a corresponding slot.

In another example of the above described centrifugal compressor each corresponding slot is an intrusion defined in a diffuser portion body.

In another example of any of the above described centrifugal compressors each corresponding slot is a hole in a radially outward flowpath wall near the exit of the impeller.

The centrifugal compressor of claim 1, wherein the equalization plenum is sealed such that the corresponding slots are the only inlet and outlet to the equalization plenum.

In another example of any of the above described centrifugal compressors the equalization plenum is disposed on a hub side of the impeller.

In another example of any of the above described centrifugal compressors the equalization plenum is disposed on a shroud side of the impeller.

In another example of any of the above described centrifugal compressors the equalization plenum includes a hub side portion and a shroud side portion.

In another example of any of the above described centrifugal compressors the diffuser portion is connected to a compressor outlet via a volute.

In another example of any of the above described centrifugal compressors the slots are defined at least partially in a diffuser portion body.

In another example of any of the above described centrifugal compressors the slots are defined at least partially in an impeller body.

In one exemplary embodiment a centrifugal compressor includes an impeller including a plurality of discrete passages, each of the discrete passages including a discrete passage exit, and an equalization plenum fluidly connected to each discrete passage exit.

In another example of the above described centrifugal compressor the equalization plenum is fluidly connected to each discrete passage exit via a plurality of equalization slots.

In another example of any of the above described centrifugal compressors each equalization slot in the plurality of equalization slots connects an exit of one of the discrete passages in the plurality of discrete passages to the equalization plenum.

In another example of any of the above described centrifugal compressors the equalization plenum is sealed such that the plurality of equalization slots is the only inlet and outlet to the equalization plenum.

In another example of any of the above described centrifugal compressors the equalization plenum is disposed on a shroud side of the impeller.

In another example of any of the above described centrifugal compressors the equalization plenum is disposed on a hub side of the impeller.

In another example of any of the above described centrifugal compressors the equalization plenum includes a first portion and a second portion distinct from the first portion.

In another example of any of the above described centrifugal compressors the first portion is disposed on a hub side of the impeller and the second portion is disposed on a shroud side of the impeller.

In another example of any of the above described centrifugal compressors the centrifugal compressor is a mixed-flow centrifugal compressor.

An exemplary method for equalizing pressure at a centrifugal compressor diffuser inlet, the method includes fluidly connecting an outlet of a plurality of discrete impeller passages with an equalization plenum.

These and other features of the present invention can be best understood from the following specification and drawings, the following of which is a brief description.

DETAILED DESCRIPTION

Figure 1:
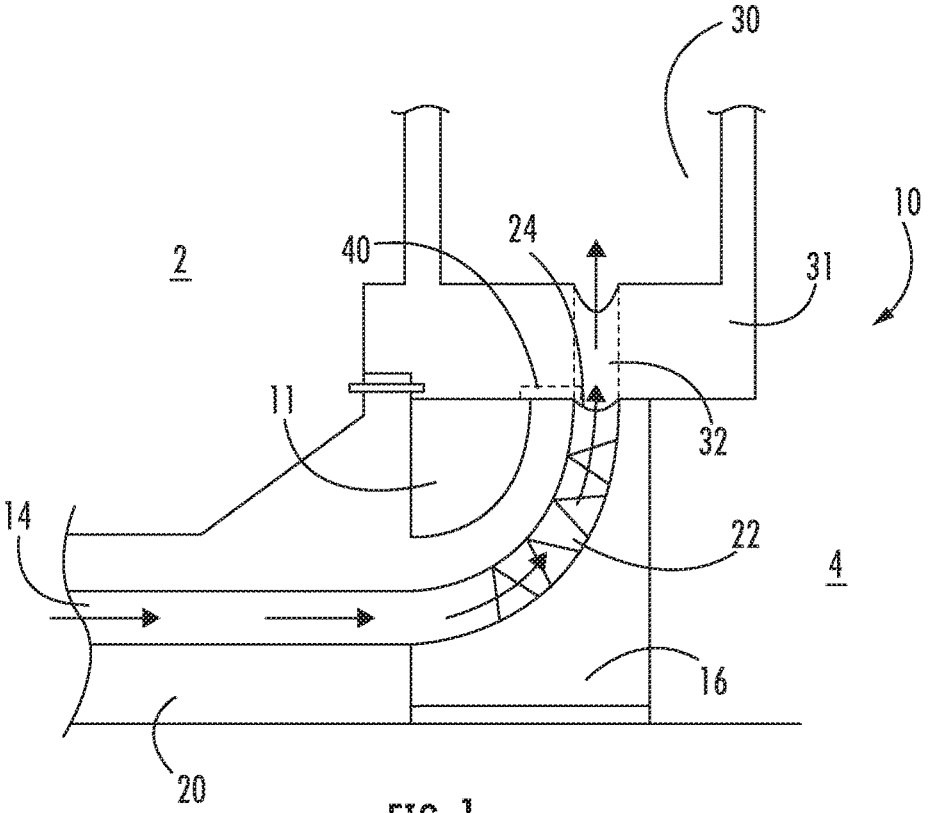
FIG. 1 illustrates a highly schematic cross sectional view of an exemplary centrifugal compressor including shroud side equalization plenum.

FIG. 1 schematically illustrates an exemplary centrifugal compressor 10 according to one example. As shown, the centrifugal compressor 10 includes an inlet 14. The inlet 14 directs fluid into a rotating impeller 16 through multiple inlet guide vanes. A drive shaft 20 is connected to the impeller 16, and drives rotation of the impeller 16. The impeller 16 defines a shroud side 2 and a hub side 4.

The impeller 16 defines multiple distinct passages 22 each of which turns the incoming fluid from an axial flow direction to a radial flow direction. The passages 22 expel the fluid from the impeller 16 into a diffuser section 30 through multiple diffuser section inlets 32. The diffuser section 30 is generally circumferentially disposed about the impeller 16 and directs the compressed fluid toward a compressor outlet. In one example, the fluid is directed into a volute which directs the fluid toward the compressor outlet see FIG. 3).

Due to the distinct passages 22, the fluid pressure at an exit 24 of each passage 22 can be different from the fluid pressure at the exit of one or more other of the passages 22. This variance is referred to as a local non-uniformity and can increase the occurrence of surge within the compressor 10. An increase in surge can cause a decrease in the total range of the compressor, which in turn decreases the overall performance of the system. In addition to the discrete passages, manufacturing variations in a body 31 defining the diffuser section 30 can create a non-uniformity at the throat of the diffuser portion which will likewise increase the surge behavior, and decrease the range of operations of the compressor 10.

Also included in the compressor 10 is a plenum 11 disposed on a shroud side 2 of the impeller 16. Each of the passages 22 is fluidly connected to the plenum 11 via a slot 40. The fluid connection with the plenum 11, by extension, connects an exit 24 of each of the passages 22 to the exit 24 of each other passage 22 through the plenum 11 and the slots 40. By connecting the passages 22 via the plenum 11, the centrifugal compressor 10 is able to provide a more uniform pressure field across the fluid exits 24 of the impeller 16 as the fluid is provided to the diffuser section 30, thereby reducing non-uniformity of flow into the diffuser section 30.

In some examples, the plenum 11 is a sealed plenum, with the only inlets and outlets being the slots 40. As a result, when the local pressure at one of the exits 24 exceeds the pressure within the plenum 11, the corresponding slot 40 allows for compressed fluid to pass into the plenum 11 and the local pressure at the exit 24 is decreased. Conversely, when the fluid pressure at an exit 24 is lower than the pressure within the plenum 11 fluid from the plenum 11 is provided to the exit 24 and the local pressure at the exit 24 is increased. As both of these features occur simultaneously, and throughout operation of the centrifugal compressor 10, the localized pressure at any given exit 24 is equalized, and the local non-uniformity of fluid pressure being provided into the diffuser section 30 is substantially reduced.

Figure 2:
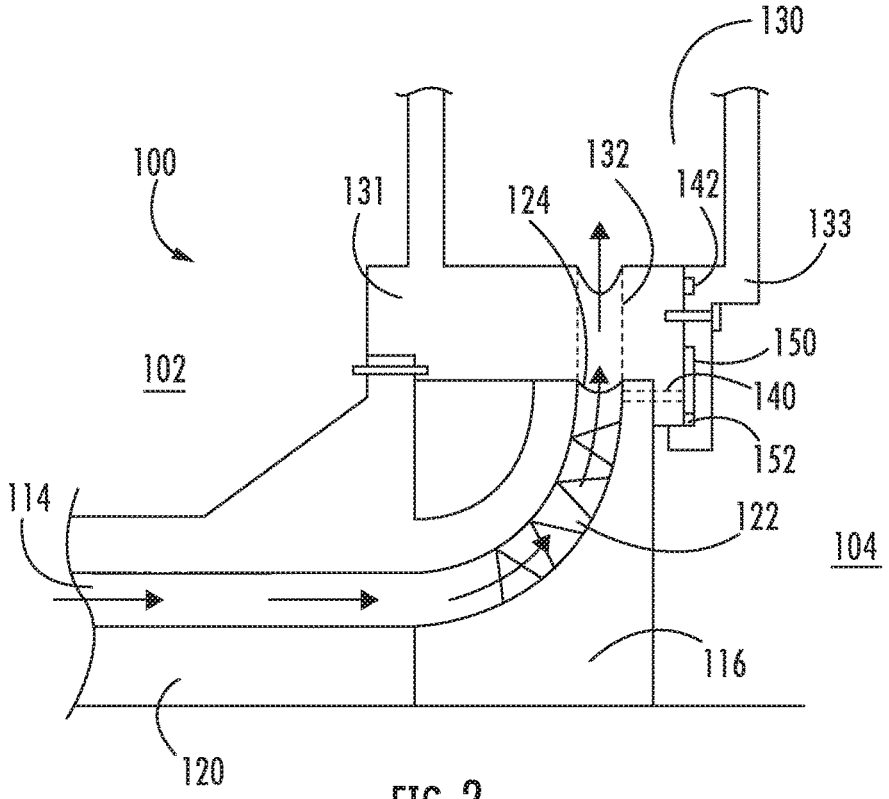
FIG. 2 illustrates a highly schematic cross sectional view of an exemplary centrifugal compressor including a hub side equalization plenum.

With continued reference to FIG. 1, and with like numerals indicating like elements, FIG. 2 schematically illustrates an exemplary centrifugal compressor 100 including a hub side 104 equalization plenum 150. As with the example of FIG. 1, the centrifugal compressor 100 includes an inlet 114. The inlet 114 directs fluid into a rotating impeller 116 through multiple inlet guide vanes. A drive shaft 120 is connected to the impeller 116, and drives rotation of the impeller 116. The impeller 116 defines a shroud side 102 and a hub side 104.

The impeller 116 defines multiple distinct passages 122 each of which turns the incoming fluid from an axial flow direction to a radial flow direct. The passages 122 expel the fluid from the impeller 116 into a diffuser section 130 through multiple diffuser section inlets 132. The diffuser section 130 is generally circumferentially disposed about the impeller 116 and directs the compressed fluid toward a compressor outlet.

Unlike the example of FIG. 1, the diffuser section 130 is defined by two bodies 131, 133 that are joined via one or more fasteners. In this example, an equalization plenum 150 is defined between the two bodies 131, 133 at the hub side 104 of the impeller 116. The equalization plenum 150 is sealed at a radially inward end and a radially outward end via a pair of seals 142, 152. In one example the seals 142, 152 can be O-ring type seals. In alternative examples, alternative seals can be utilized to the same effect.

Slots 140 are defined in the impeller 116 body and the diffuser portion body 131. The slots 140 fluidly connect each of the exits 124 to the hub side equalization plenum 150. The hub side equalization plenum 150 operates to equalize the local pressure at the exits 124 in the same manner as the shroud side equalization plenum 11 of FIG. 1.

Figure 3:
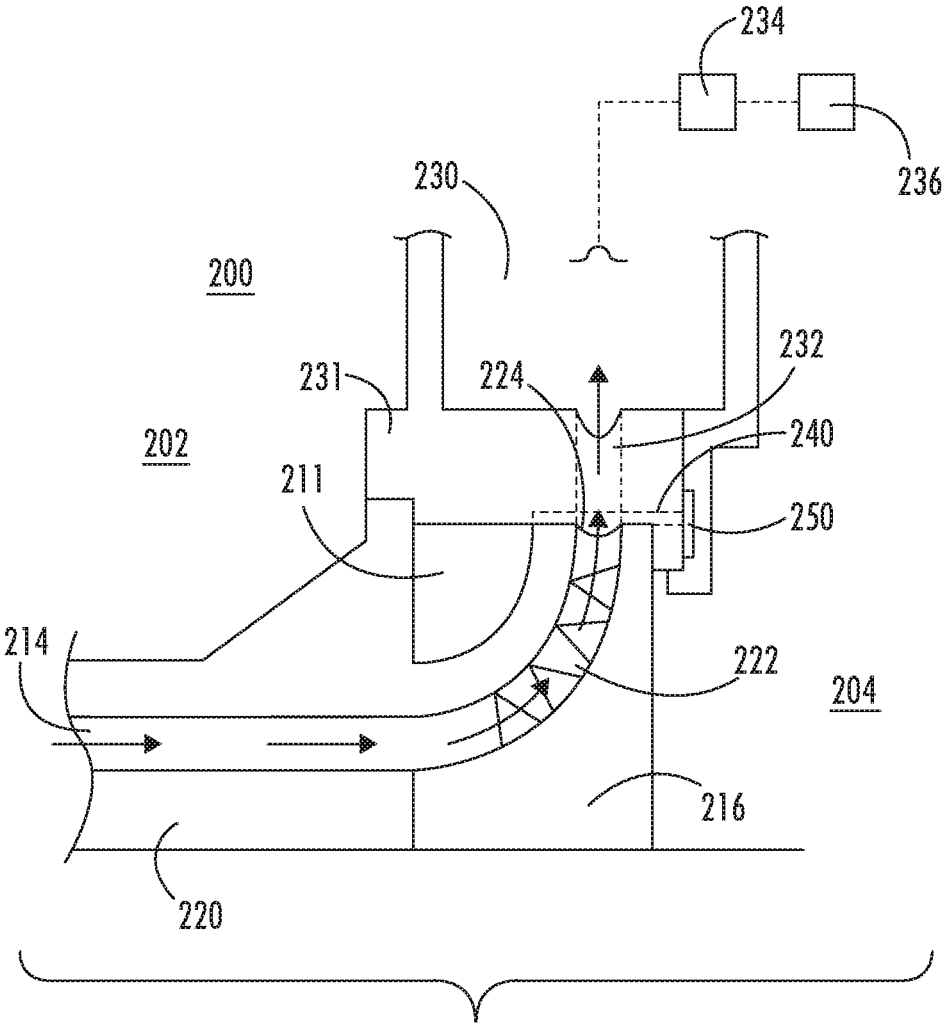
FIG. 3 illustrates a highly schematic cross sectional view of an exemplary centrifugal compressor including an equalization plenum having hub and shroud side portions.

With continued reference to FIGS. 1 and 2, FIG. 3 schematically illustrates a combination of the concepts of FIGS. 1 and 2 into a single embodiment. In the example of FIG. 3, the centrifugal compressor 200 includes an inlet 214. The inlet 214 directs fluid into a rotating impeller 216 through multiple inlet guide vanes. A drive shaft 220 is connected to the impeller 216, and drives rotation of the impeller 216. The impeller 216 defines a shroud side 202 and a hub side 204.

The impeller 216 defines multiple distinct passages 222 each of which turns the incoming fluid from an axial flow direction to a radial flow direct. The passages 222 expel the fluid from the impeller 216 into a diffuser section 230 through multiple diffuser section inlets 232. The diffuser section 230 is generally circumferentially disposed about the impeller 216 and directs the compressed fluid toward a compressor outlet 236 through a volute 234.

In the example of FIG. 3, each of the hub side plenum portion 250 and the shroud side plenum portion 211 are connected to the exit 224 via slots 240 in a body 231 that partially defines the diffuser section 230. Each of the slots 240 provides a single fluid connection connecting a corresponding diffuser section inlet 232 to each of the plenum portions 211, 250. As with the previous examples, the combination of a shroud side 202 equalization plenum portion 211 and a hub side 204 equalization plenum portion 250 operates to equalize the pressure at the inlets 232 to the diffuser section 230 thereby reducing the local non-uniformity within the diffuser section 230.

With reference to all of FIGS. 1-3, it is appreciated that providing for a balance of the static pressures between the diffuser inlets 32, 132, 232 assists in inhibiting stalling behaviors under varying diffuser incidence angle conditions. The balanced pressure at the diffuser inlets 32, 132, 232 also provides incidence-relief in the swirling flow field. The exact location and length of the slots, as well as which equalization plenum configuration to be used depends on the specific features and conditions of a given centrifugal compressor design and application, and can be determined by one of skill in the art.

While described and illustrated herein with reference to a mixed flow centrifugal compressor, it is appreciated that the local non-uniformity mitigating feature provided by the equalization plenums can be applied to any alternative centrifugal flow compressor and are not limited to the specific example described and illustrated herein.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A centrifugal compressor comprising:

an impeller configured to drive fluid along a fluid flowpath via a plurality of discrete passages, each of the discrete passages being defined by the impeller and including a discrete passage exit;

a diffuser portion disposed circumferentially about the impeller, the diffuser portion including a plenum connected to each exit of the discrete passages via a plurality of diffuser inlets; and an equalization plenum defined adjacent to the impeller, the equalization plenum being fluidly connected to each discrete passage exit via a corresponding slot, wherein the slot comprises a first slot portion defined entirely by the impeller and a second slot portion defined entirely by the diffuser portion, an outlet of the first slot portion being fluidly connected to an inlet of the second slot portion.

2. The centrifugal compressor of claim 1, wherein each corresponding slot is an intrusion defined in a diffuser portion body.

3. The centrifugal compressor of claim 1, wherein each corresponding slot is a hole in a radially outward flowpath wall adjacent the exit of the impeller.

4. The centrifugal compressor of claim 1, wherein the equalization plenum is sealed such that the corresponding slots are the only inlet and outlet to the equalization plenum.

5. The centrifugal compressor of claim 1, wherein the equalization plenum is disposed entirely on a hub side of the impeller.

6. The centrifugal compressor of claim 1, wherein the equalization plenum is disposed entirely on a shroud side of the impeller.

7. The centrifugal compressor of claim 1, wherein the equalization plenum includes a hub side portion and a shroud side portion.

8. The centrifugal compressor of claim 1, wherein the diffuser portion is connected to an outlet of the compressor via a volute within the compressor.

9. The centrifugal compressor of claim 1, wherein the slots are defined at least partially in a diffuser portion body.

10. The centrifugal compressor of claim 1, wherein the slots are defined at least partially in an impeller body.

11. The centrifugal compressor of claim 1, wherein at least a portion of the plenum is defined radially inward of the discrete passage exits.

12. The centrifugal compressor of claim 11, wherein the plenum is at least partially defined by a wall of the impeller.

* * * * *